US008505520B2

(12) United States Patent
Spix et al.

(10) Patent No.: US 8,505,520 B2
(45) Date of Patent: Aug. 13, 2013

(54) ENGINE ASSEMBLY INCLUDING POSITIVE CRANKCASE VENTILATION WITH OIL SURGE PROTECTION

(75) Inventors: Thomas A. Spix, Rochester Hills, MI (US); Steven G. Bryde, Davisburg, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 148 days.

(21) Appl. No.: 13/211,705

(22) Filed: Aug. 17, 2011

(65) Prior Publication Data

US 2013/0042844 A1 Feb. 21, 2013

(51) Int. Cl.
*F02M 25/06* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS 3,585,976 A * 6/1971 Rider ..... 123/327
5,502,984 A * 4/1996 Boehde et al. ..... 62/470
6,606,982 B1 * 8/2003 Stockhausen et al. ..... 123/572
6,773,494 B1 * 8/2004 Ganz ..... 96/414
2002/0129586 A1 * 9/2002 Tanaka ..... 55/320
2009/0090337 A1 * 4/2009 Asanuma et al. ..... 123/574
2009/0301446 A1 * 12/2009 Asanuma et al. ..... 123/559.1
2010/0012103 A1 * 1/2010 Lewis et al. ..... 123/574
2010/0031904 A1 * 2/2010 Matsuura et al. ..... 123/41.86
2010/0089345 A1 * 4/2010 Kim et al. ..... 123/41.86

FOREIGN PATENT DOCUMENTS

KR 2003073362 A * 9/2003

* cited by examiner

*Primary Examiner* — M. McMahon
(74) *Attorney, Agent, or Firm* — Harness, Dickey & Pierce, P.L.C.

(57) ABSTRACT

An engine assembly includes an engine structure, an intake air assembly and a crankcase ventilation line assembly. The engine structure defines a cylinder bore, an intake port in communication with the cylinder bore, and a crankcase. The air intake assembly is in communication with the intake port. The crankcase ventilation line assembly includes a fresh air line and an oil surge protection device. The fresh air line is in communication with the crankcase and the air intake assembly and provides fresh air to the crankcase. The oil surge protection device is in communication with the fresh air line and defines an oil obstruction inhibiting oil flow to the air intake assembly while allowing air flow between the crankcase and the air intake assembly.

8 Claims, 4 Drawing Sheets

ENGINE ASSEMBLY INCLUDING POSITIVE CRANKCASE VENTILATION WITH OIL SURGE PROTECTION

FIELD

The present disclosure relates to engine positive crankcase ventilation systems.

BACKGROUND

This section provides background information related to the present disclosure which is not necessarily prior art.

Internal combustion engines may combust a mixture of air and fuel in cylinders and thereby produce drive torque. A portion of the combustion gases (blowby) may escape the combustion chamber past the piston and enter the engine crankcase. Crankcase ventilation systems may be incorporated into engines in order to mitigate the effects of blowby gases in the crankcase.

SUMMARY

An engine assembly may include an engine structure, an intake air assembly and a crankcase ventilation line assembly. The engine structure may define a cylinder bore, an intake port in communication with the cylinder bore, and a crankcase. The air intake assembly may be in communication with the intake port. The crankcase ventilation line assembly may include a fresh air line and an oil surge protection device. The fresh air line may be in communication with the crankcase and the air intake assembly and may provide fresh air to the crankcase. The oil surge protection device may be in communication with the fresh air line and may define an oil obstruction inhibiting oil flow to the air intake assembly while allowing air flow between the crankcase and the air intake assembly.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
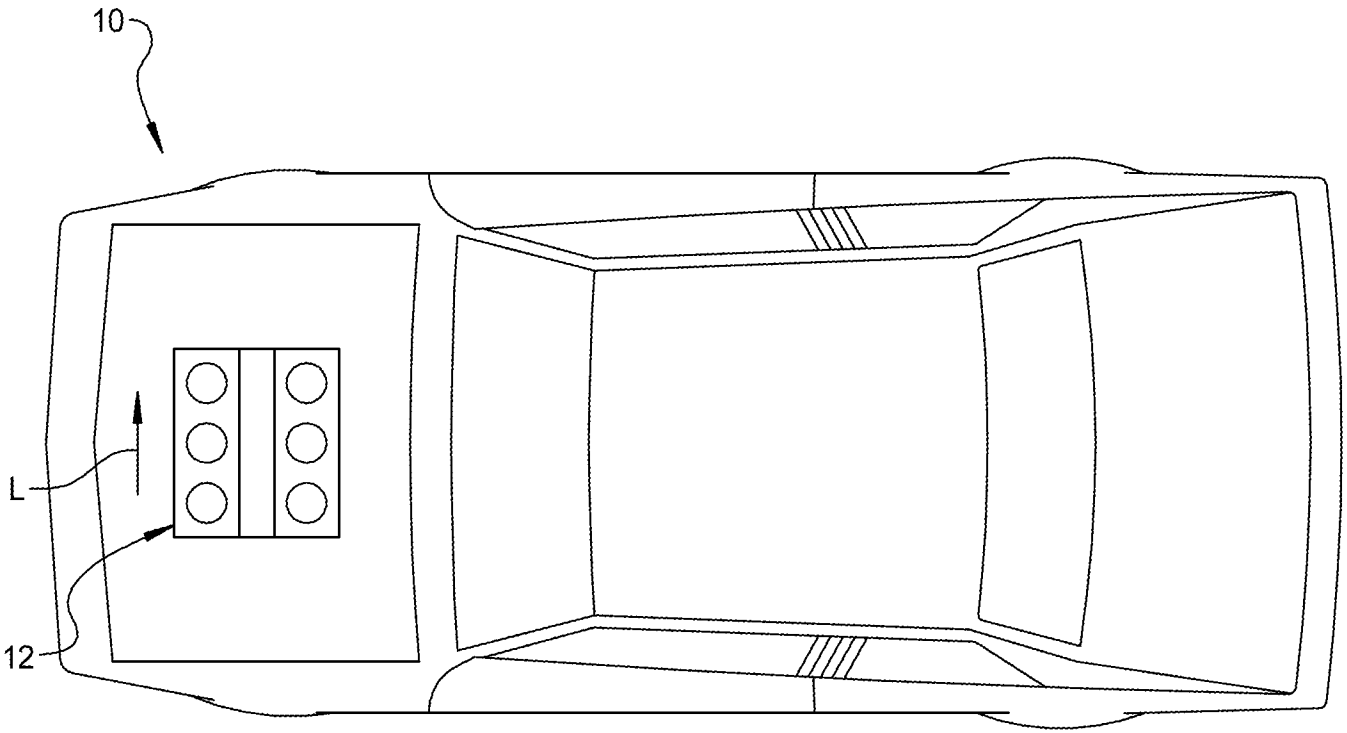
FIG. 1 is schematic illustration of a vehicle according to the present disclosure.
Figure 2:
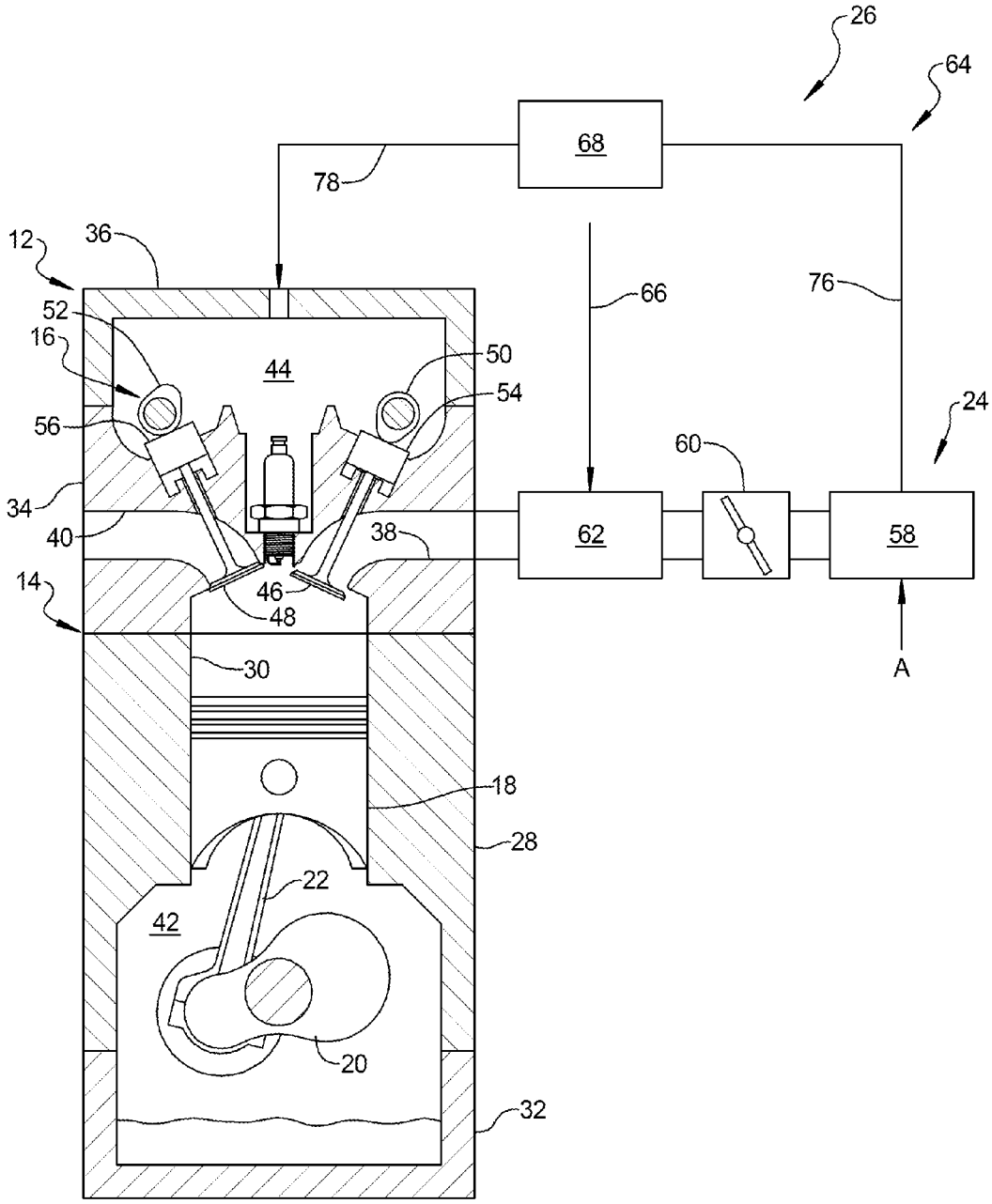
FIG. 2 is a schematic illustration of the engine assembly shown in FIG. 1.
Figure 3:
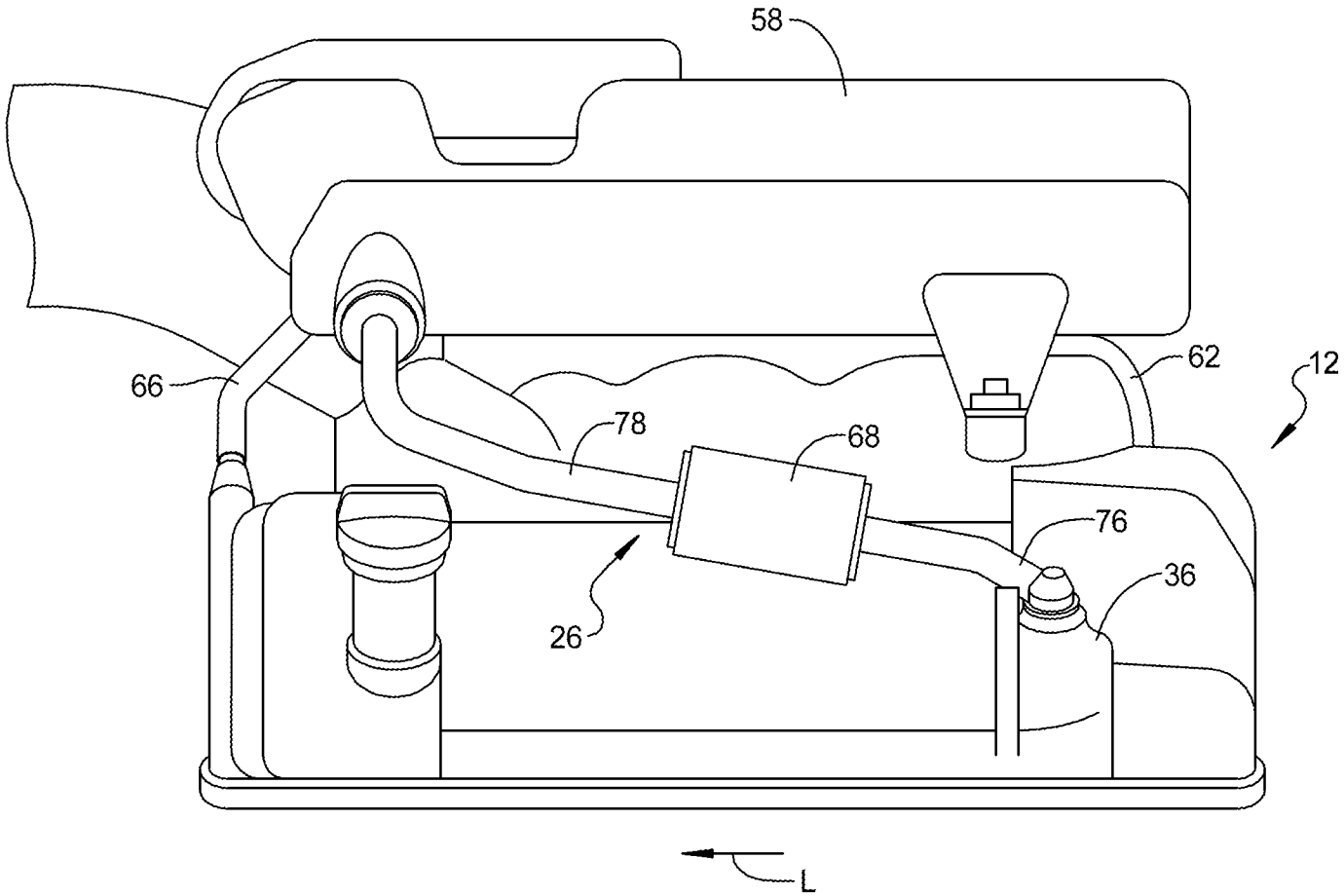
FIG. 3 is a fragmentary perspective view of the engine assembly of FIG. 2.

As seen in FIG. 1, a vehicle 10 may include a transversely mounted engine assembly 12. With additional reference to FIGS. 2 and 3, the engine assembly 12 may include an engine structure 14, a valvetrain assembly 16, pistons 18, a crankshaft 20, connecting rods 22 coupling the pistons 18 to the crankshaft 20, an air intake assembly 24 and a crankcase ventilation line assembly 26. The engine structure 14 may include an engine block 28 defining cylinder bores 30, an oil pan 32 coupled to the engine block 28, a cylinder head 34 coupled to the engine block 28 and a cylinder head cover 36 coupled to the cylinder head 34. The cylinder head 34 may define intake and exhaust ports 38, 40. While the engine assembly 12 is illustrated as a V6 configuration, it is understood that the present teachings apply to any number of piston-cylinder arrangements and a variety of reciprocating engine configurations including, but not limited to, V-engines, inline engines, and horizontally opposed engines. Further, the present disclosure is not limited to transversely mounted engine arrangements and may also be incorporated into longitudinally mounted engine arrangements. It is also understood that the present disclosure is applicable to all types of engine ventilation arrangements including, but not limited to positive crankcase ventilation systems and closed crankcase ventilation systems, as well as both gasoline and diesel engines.

The engine structure 14 may define a crankcase 42 in communication with the air intake assembly 24 via the crankcase ventilation line assembly 26. The crankcase 42 may be in communication with a volume 44 defined by the cylinder head 34 and cylinder head cover 36 via passages (not shown) defined by the cylinder head 34. The valvetrain assembly 16 may include intake and exhaust valves 46, 48, intake and exhaust camshafts 50, 52, intake valve lift mechanisms 54 engaged with the intake valves 46 and the intake camshafts 50 and exhaust valve lift mechanisms 56 engaged with the exhaust valves 48 and the exhaust camshafts 52.

The air intake assembly 24 is in communication with the intake ports 38 and may include an air induction assembly 58, a throttle valve 60 and an intake manifold 62. The crankcase ventilation line assembly 26 may be in communication with the crankcase 42 and the air intake assembly 24 and may include a fresh air line 64, a foul air line 66 and an oil surge protection device 68. The fresh air line 64 may be in communication with the crankcase 42 and the air intake assembly 24 at a location upstream of the throttle valve 60 to provide fresh air to the crankcase 42. In the present non-limiting example, the fresh air line extends from the cylinder head cover 36 to the air induction assembly 58 and is in communication with the volume 44 defined by the cylinder head 34 and the cylinder head cover 36. The foul air line 66 may be in communication with the crankcase 42 and the air intake assembly 24 at a location downstream of the throttle valve 60 to remove blowby gases from the crankcase 42. A PCV separator (not shown) may be located in the flow path from the crankcase 42 to the foul air line 66 to remove oil from the blowby gases before the gases reach the air intake assembly 24.

Figure 4:
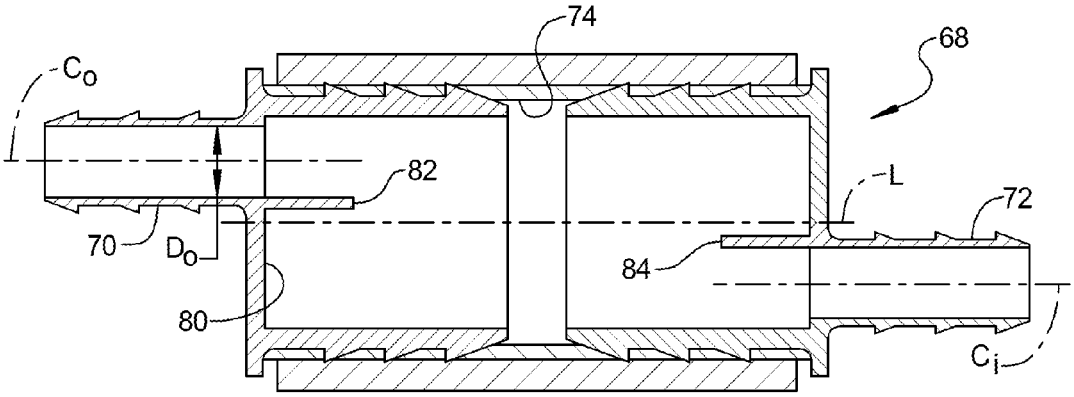
FIG. 4 is a section view of the oil surge protection device shown in FIG. 3.

The oil surge protection device 68 may be in communication with the fresh air line 64 and defines an oil obstruction inhibiting oil flow to the air intake assembly 24. With additional reference to FIG. 4, the oil surge protection device 68 may define an air outlet 70 in communication with the air intake assembly 24, an air inlet 72 in communication with the crankcase 42 and a chamber 74 defined between the air outlet 70 and the air inlet 72. In the present non-limiting example, the fresh air line 64 includes first and second portions 76, 78 and the oil surge protection device 68 is located in the fresh air line 64 between the first and second portions 76, 78.

The air outlet 70 and the air inlet 72 may be offset relative to one another and relative to a longitudinal centerline (L) of the chamber 74. More specifically, the air outlet 70 may be offset radially upward relative to the air inlet 72. In the present non-limiting example, a centerline ($C_o$) of the air outlet 70 is radially offset from a centerline ($C_i$) of the air inlet 72 by a distance greater than a diameter ($D_o$) defining the air outlet 70. More specifically, the entire air outlet 70 may be located in an upper radial half of the chamber 74 and the entire air inlet 72 may be located in lower radial half of the chamber 74. The radial offset between the air outlet 70 and the air inlet 72 may form an oil obstruction to inhibit oil flow in a direction from the air inlet 72 toward the air outlet 70 as discussed below.

During operation, oil may accumulate in the volume 44 defined between the cylinder head 34 and the cylinder head cover 36. Due to the transverse mounting of the engine assembly 12 within the vehicle 10, during high-g turns oil may rush to and accumulate at the rear of the volume 44 defined between the cylinder head 34 and the cylinder head cover 36. In the non-limiting example illustrated, oil may rush to the rear of the cylinder head 34 during right turns (indicated by arrow "L" in FIGS. 1 and 3).

The oil surge protection device 68 may inhibit oil flow through the fresh air line 64 to the air intake assembly 24. More specifically, due to the offset between the air outlet 70 and the air inlet 72, a wall 80 may be formed at an end of the chamber 74 below the air outlet 70. Therefore, when oil enters the oil surge protection device 68 during high-g turns, the oil impacts the wall 80 and is preventing from flowing directly into the second portion 78 of the fresh air line 64, and ultimately to the air intake assembly 24. The lower location of the air inlet 72 provides for return flow of oil to the volume 44. The oil surge protection device 68 may additionally include a longitudinally extending wall 82 below the air outlet 70 and a longitudinally extending wall 84 above the air inlet 72 to further prevent oil from flowing directly into the second portion 78 of the fresh air line 64.

Figure 5:
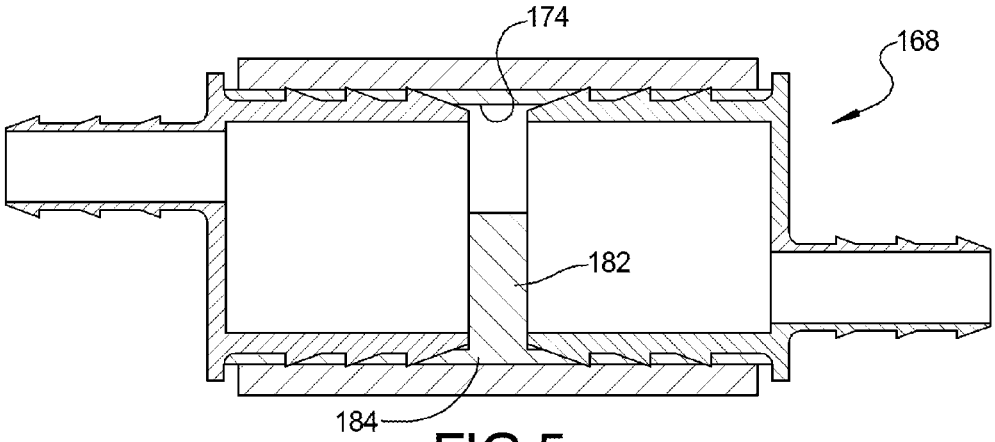
FIG. 5 is a section view of an alternate oil surge protection device according to the present disclosure.
Figure 6:
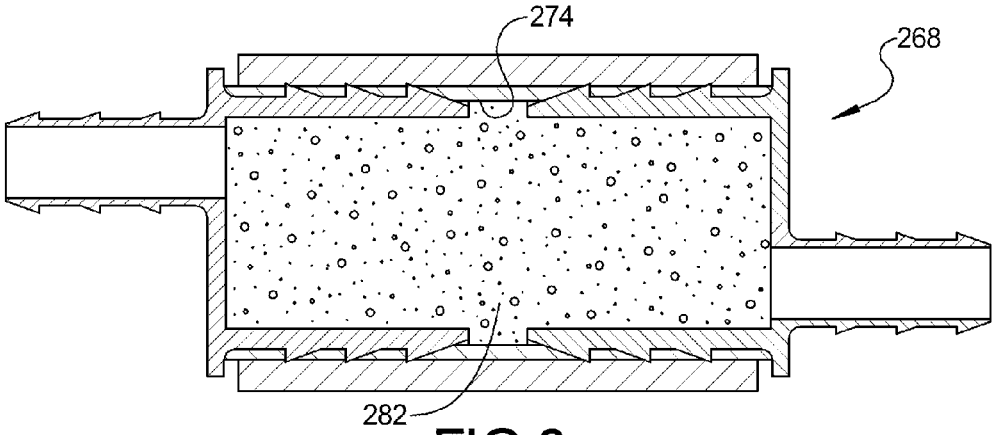
FIG. 6 is a section view of an alternate oil surge protection device according to the present disclosure.

Alternate oil surge protection devices 168, 268 are illustrated in FIGS. 5 and 6. As seen in FIG. 5, a wall 182 may extend from a lower portion 184 of the chamber 174. The wall 182 is illustrated schematically for simplicity, but may be part of a more complex baffle or labyrinth arrangement. As seen in FIG. 6, a media 282 may alternatively or additionally be included within the chamber 274 of the oil surge protection device 268 to further obstruct oil flow. The media 282 may include a variety of materials including, but not limited to metal wools (made from materials including steel, stainless steel, brass or copper, for example), fibers (such as nylon mesh or polyester batting, for example), open cell foams and filter media or materials.

What is claimed is:

1. An engine assembly comprising:

an engine structure defining a cylinder bore, an intake port in communication with the cylinder bore, and a crankcase;

an air intake assembly in communication with the intake port; and a crankcase ventilation line assembly including:

a fresh air line in communication with the crankcase and the air intake assembly and providing fresh air to the crankcase; and an oil surge protection device located in the fresh air line and defining an oil obstruction inhibiting oil flow to the air intake assembly while allowing air flow between the crankcase and the air intake assembly, wherein the oil surge protection device includes an air inlet in communication with the air intake assembly, an air outlet in communication with the crankcase and a chamber defined between the air inlet and the air outlet with the air inlet and the air outlet offset relative to one another and relative to a longitudinal centerline of the chamber, wherein the air inlet is radially offset upward relative to the air outlet.

2. The engine assembly of claim 1, wherein the engine structure includes a cylinder head and a cylinder head cover fixed to the cylinder head defining a volume in communication with the crankcase and the fresh air line.

3. The engine assembly of claim 2, wherein the oil surge protection device is located within an air flow path defined between the air intake assembly and the volume.

4. The engine assembly of claim 2, wherein the oil surge protection device inhibits oil accumulated within the volume from flowing into the air intake assembly.

5. The engine assembly of claim 1, wherein a centerline of the air outlet is radially offset from a centerline of the air outlet by a distance greater than a diameter defining the air inlet.

6. The engine assembly of claim 1, wherein the oil surge protection device includes an air inlet in communication with the air intake assembly, an air outlet in communication with the crankcase and a chamber defined between the air inlet and the air outlet and housing a media obstructing oil flow within the chamber.

7. The engine assembly of claim 6, wherein the chamber includes a wall extending from a lower surface thereof and maintaining oil traveling from the crankcase to the oil surge protection device within a region of the chamber defined between the wall and the air inlet.

8. The engine assembly of claim 1, wherein the air intake assembly includes a throttle valve and the fresh air line is in communication with the air intake assembly at a location upstream of throttle valve and the crankcase ventilation line assembly includes a foul air line in communication with the crankcase and the air intake assembly at a location downstream of the throttle valve.

* * * * *